United States Patent [19]

Cunning

[11] 4,280,399

[45] Jul. 28, 1981

[54] ROOF RIDGE VENTILATOR

[75] Inventor: Joseph M. Cunning, Cohasset, Mass.

[73] Assignee: Bird & Son, Inc., East Walpole, Mass.

[21] Appl. No.: 154,386

[22] Filed: May 29, 1980

[51] Int. Cl.[3] ..... F24F 7/02

[52] U.S. Cl. ..... 98/42 A; 52/199; 98/31

[58] Field of Search ..... 52/199, 303; 98/2.14, 98/2.15, 31, 42 R, 42 A, 43 C

[56] References Cited

U.S. PATENT DOCUMENTS

| | | | |
|---|---|---|---|
| Re. 27,943 | 3/1974 | Smith | 98/42 A |
| 1,028,725 | 6/1912 | Hodgson | 98/42 A |
| 2,049,863 | 8/1936 | Palmer | 52/303 X |
| 2,388,759 | 11/1945 | Moore | 98/42 A |
| 2,799,214 | 7/1957 | Roose | 98/42 A |
| 2,988,980 | 6/1961 | Tschudin | 98/31 X |
| 3,236,170 | 2/1966 | Meyer et al. | 98/42 A |
| 3,241,474 | 3/1966 | Rousey | 98/42A |
| 3,326,113 | 6/1967 | Smith et al. | 98/42 A |
| 3,625,134 | 12/1971 | Smith | 52/199 X |
| 3,949,657 | 4/1976 | Sells | 98/42 A |

*Primary Examiner*—Edward G. Favors
*Assistant Examiner*—Harold Joyce

[57] ABSTRACT

A flexible, one-piece, corrugated, roof ridge ventilator is disclosed which may be mounted transversely across any roof ridge regardless of its contours or roof angles. It has a plurality of longitudinally extending peaks and valleys with side walls extending therebetween, the side walls having a plurality of venting perforations therein for venting of air therethrough from a roof ridge vent to the exterior of the roof.

3 Claims, 3 Drawing Figures

ROOF RIDGE VENTILATOR

This invention relates to roof ridge ventilators, and more particularly to a one-piece roof ridge ventilator.

The use of roof ridge ventilators for venting hot and humid air trapped in the attics of houses to pevent damage to things stored in the attics and to lower the temperature within houses and other buildings is well known in the prior art. Roof ridge ventilators in the prior art are usually deficient in several aspects, however. For example, they may be bulky and unsightly as shown in Rousey et al., U.S. Pat. No. 3,241,474, or composed of many parts as shown in Smith, U.S. Pat. No. Re. 27,943. Moreover, such roof ridge ventilators of the prior art are difficult to install because they do not conform to the contours of roof ridges and are not readily adaptable to accommodate a variety of roof angles.

In view of such deficiencies in the prior art, it is a major object of the present invention to provide a roof ridge ventilator which is capable of conforming to the contour and angle of any roof ridge to facilitate easy installation.

It is another object of the present invention to provide a one-piece roof ridge ventilator.

It is a further object of the present invention to provide a roof ridge ventilator which is inconspicuous and attractive when installed.

In order to accomplish the above and still further objects, the present invention provides, for use with a building roof ridge having a ridge pole supported on each side by rafters extending to the ridge pole spaced therealong and sloping downwardly therefrom, with sheathing and roof shingles supported by the rafters and having their inner longitudinal edges spaced from the ridge pole to provide a building roof vent extending longitudinally along at least one side of the ridge pole, a flexible, one-piece, roof ridge ventilator adapted for mounting transversely across the roof ridge with its outer longitudinal edges spaced transversely outwardly from the ridge pole for supporting thereon a longitudinally and transversely extending cap shingle with its longitudinally extending outer edges spaced above and transversely overlapping the roof shingles on both sides of the ridge pole for ventilation of the building through the roof vent.

The roof ridge ventilator of the invention has a plurality of longitudinally extending peaks and valleys with side walls extending continuously therebetween, including a central valley adapted for mounting on the ridge pole and for centering the ridge ventilator sheet transversely across the roof ridge with side peaks and valleys extending from the ridge pole for a substantial distance to the outer longitudinal edges of the ventilator for overlapping the sheathing and shingles on both sides of the ridge pole.

The central valley and the side valleys of the ventilator have nail apertures therein for securing the roof ridge ventilator onto both the ridge pole and the sheathing and shingles with the outermost ones of the side peaks having nail apertures therein adapted to receive nails for securing the cap shingle to the ridge ventilator. The side walls have a plurality of venting perforations therein for venting of air therethrough from the roof vent to the exterior of the roof.

The corrugated ventilator may include upwardly and outwardly turned flanges extending continuously along its outer longitudinal edges to prevent entry of moisture into the roof vent while allowing venting through the roof ridge ventilator. In addition, the flanges have a plurality of water run-off perforations therein to allow the exit of water therethrough, thereby eliminating the accumulation of water in the ventilator due to run-off water from the cap shingles.

Before installation, all of the peaks of the corrugated ventilator lie in a common plane and the side valleys lie in a plane parallel thereto with the central valley spaced below the valley plane before installation. After installation across the roof ridge, the side peaks and side valleys lie in parallel planes on each side of the ridge pole.

Other objects, features, and advantages of the present invention will appear from the following detailed description of a preferred embodiment thereof, taken together with the accompanying drawings, wherein.

Figure 1:
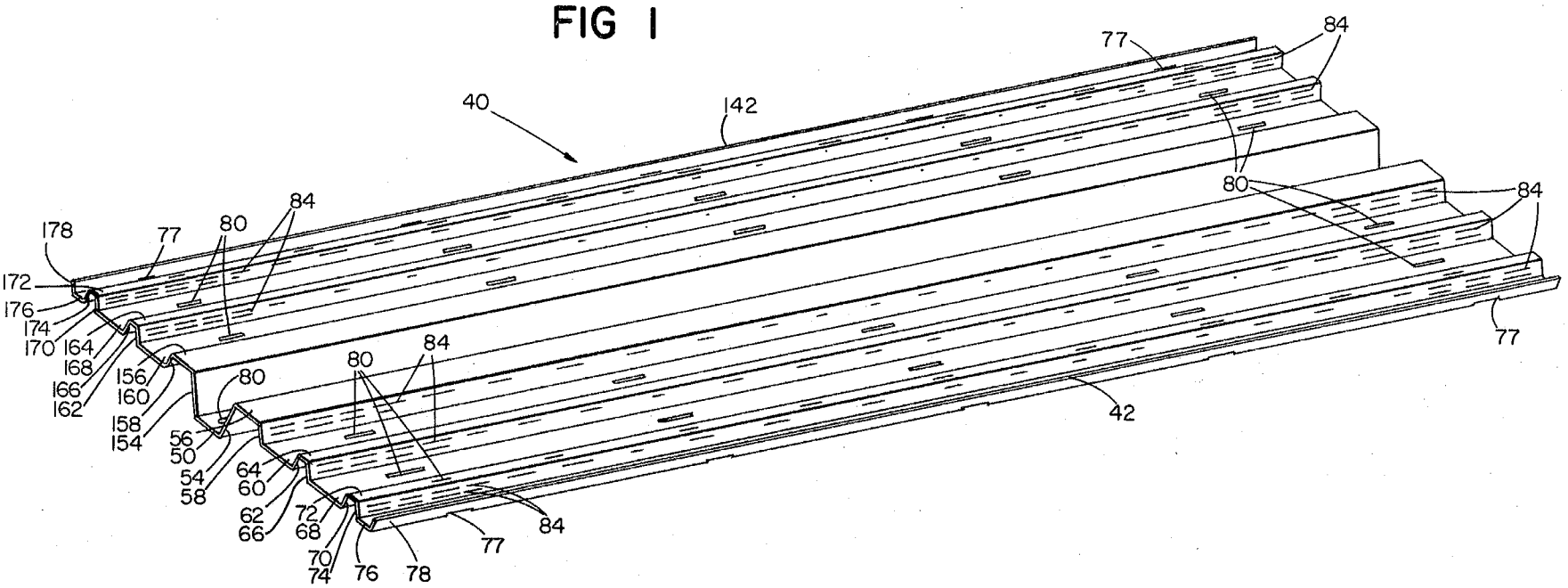
FIG. 1 is a perspective view of the roof ridge ventilator of the present invention before its installation on a roof.
Figure 2:
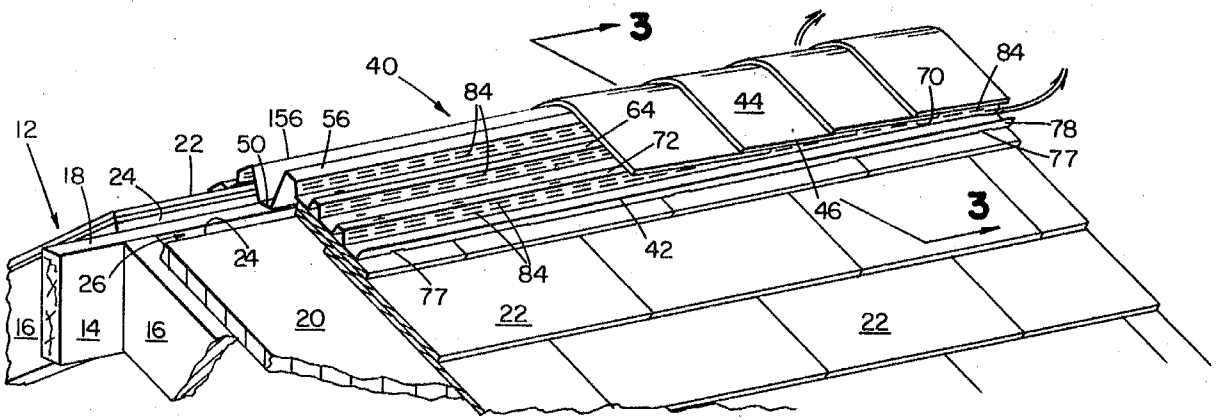
FIG. 2 is a perspective view, partly broken away, of the roof ridge ventilator of FIG. 1 mounted on a building roof ridge.
Figure 3:
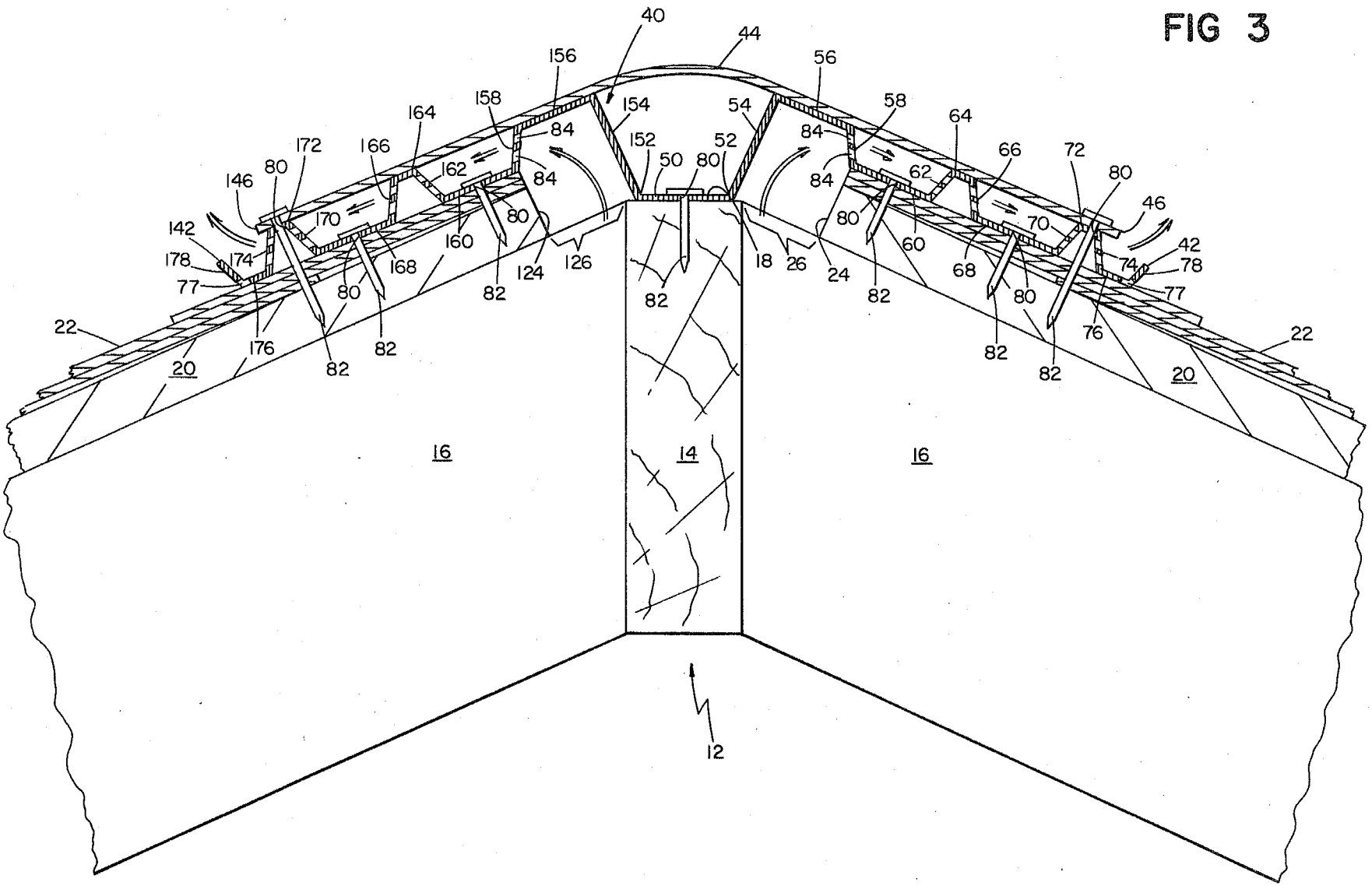
FIG. 3 is a side cross sectional view of the roof ridge ventilator and the roof ridge of FIG. 2, taken along line 3—3 of FIG. 2.

Referring to the drawings, the flexible, one-piece, roof ridge ventilator of the invention, generally designated 40 and shown in FIG. 1 before its installation on a roof, is shown in FIGS. 2 and 3 mounted across a building roof ridge, generally designated 12.

More specifically, roof ridge 12 comprises ridge pole 14 supported on each side by rafters 16 extending to ridge pole 14 and sloping downwardly therefrom. Sheathing 20 and roof shingles 22, supported by rafters 16 and having their inner longitudinal edges 24 and 124 spaced from ridge pole 14, together with rafters 16, provide a pair of building roof ridge vents 26 and 126 extending longitudinally along both sides of ridge pole 14. Each of the inner longitudinal edges 24 and 124 is spaced approximately one inch away from ridge pole 14. In addition, the height of sheathing 20 and shingles 22, at each of the inner longitudinal edges 24 and 124, is also approximately one inch.

The novel roof ridge ventilator 40 of the present invention is adapted for mounting transversely across any roof ridge 12 regardless of its included roof angle, with outer longitudinal edges 42 and 142 of ventilator 40 spaced transversely and outwardly from ridge pole 14. Ventilator 40, in addition, supports thereon a plurality of longitudinally and transversely extending cap shingles 44 with their longitudinally extending outer edges 46 and 146 spaced above and transversely overlapping the roof shingles 22 on both sides of ridge pole 14 for ventilating the building through roof ridge vents 26 and 126. Ventilator 40 may be formed from any metal, plastic or other suitable material.

As may be seen in FIG. 1, as formed and before installation, all of the side peaks of ventilator 40 lie in a common plane and the side valleys lie in a plane parallel thereto with the central valley spaced below the side valley plane. After installation across the roof ridge, as shown in FIGS. 2 and 3, the side peaks and side valleys lie in parallel planes on each side of ridge pole 14.

More specifically, roof ridge ventilator 40 includes a wide, generally flat, central valley base portion 50 adapted for mounting on ridge pole 14 and for centering ventilator 40 transversely across roof ridge 12, with central valley side wall portions 54 and 154 extending upwardly from base portion 50 and ridge pole 14 for a substantial distance to inner peak portions 56 and 156 of ventilator 40. Central valley side wall portions 54 and 154 are flexibly connected to base portion 50 at generally orthogonal bends 52 and 152, respectively.

The side peaks and side valleys preferably number three on each side and include, on one side of central valley base portion 50, in addition to inner peak portion 56, intermediate peak portion 64, outer peak portion 72, intermediate valley portion 60 and outer valley portion 68. Intermediate valley portion 60 is generally flat and is connected to inner peak portion 56 by side wall portion 58 and to intermediate peak portion 64 by side wall portion 62. Outer valley portion 68 is also generally flat and is connected to intermediate peak portion 64 by side wall portion 66 and to outer peak portion 72 by side wall portion 70. An outer flange portion 76 having an outer upturned edge portion 78 defining outer edge 42 of ventilator 40 is connected to outer peak portion 72 by side wall 74 to prevent entry of moisture into the roof vent 26 while allowing venting through the roof ridge ventilator 40.

Similarly, the mirror image of the side peaks and valleys on the other side of central valley base portion 50, in addition to inner peak portion 156, include intermediate peak portion 164, outer peak portion 172, intermediate valley portion 160 and outer valley portion 168. Intermediate valley portion 160 is generally flat and is connected to inner peak portion 156 by side wall portion 158 and to intermediate peak portion 164 by side wall portion 162. Outer valley portion 168 is also generally flat and is connected to intermediate peak portion 164 by side wall portion 166 and to outer peak portion 172 by side wall portion 170. An outer flange portion 176 having an outer upturned edge portion 178 defining outer edge 142 of ventilator 40 is connected to outer peak portion 172 by side wall portion 174.

Central valley base portion 50 and side valley portions 60, 68, 160 and 168 have nail apertures 80 therein, adapted to receive nails 82 for securing the roof ridge ventilator 40 onto both the ridge pole 14 and the sheathing 20 and shingles 22, respectively. In addition, outer peak portions 72 and 172 also have nail apertures 80 therein adapted to receive nails 82 for securing the cap shingle 44 to the ridge ventilator 40. Ventilators 40 formed from metallic materials need not include nail apertures 80, for such ventilators 40 are easily pierced by nails 82.

The generally slanting valley side wall portions 58, 158, 62, 162, 66, 166, 70, 170, 74 and 174 have a plurality of venting perforations 84 therein for venting the attic air therethrough from the roof vents 26 and 126 to the exterior of the roof.

Outer flange portions 76 and 176 have water run-off apertures 77 therein to allow the exit of water therethrough, thereby eliminating any accumulation of water in outer flange portions 76 and 176 due to run-off water from cap shingles 44.

In the preferred embodiment, the approximate dimension of ventilator 40 is as follows: transverse width of 12 inches; width of central valley base portion 50 of one inch; depth of each of the central valley side wall portions 54, 154 of $1\frac{1}{2}$ inches, which is substantially greater than the thickness of sheathing 20 and shingles 22 in order to accommodate the mounting of side peaks and side valleys onto shingles 22; width of each of the inner peak portions 56, 156 of one inch; width of each side peak of $\frac{1}{2}$ inch; width of each side valley of one inch; height of each side wall of $\frac{1}{2}$ inch; and height of each of the flanges 78, 178 of $\frac{5}{8}$ inch. In addition, gaps of approximately $\frac{1}{2}$ inch in width are provided between the outer edges 46 and 146 of cap shingles 44 and the corresponding flanges 78 and 178 of ventilator 40 for venting air.

In operation, the novel flexible, one-piece, roof ridge ventilator 40 can be mounted transversely across the roof ridge 12 of any building regardless of its roof angle, especially an older building with a skewed, asymmetrical or undulating roof ridge due to a sagging roof pole, rafters or building walls. Since it bends primarily at bends 52 and 152, flexible ventilator 40 conforms readily to the contours of roof ridge 12, best shown in FIG. 3. As mounted, the side peaks and side valleys lie in parallel planes on each side of ridge pole 14, providing planar surfaces for the mounting of cap shingles 44 thereon. Roof ridge ventilator 40, in addition, can be quickly centered with respect to roof ridge 12 when the generally flat central valley base portion 50 is nailed to the generally flat top surface 18 of ridge pole 14. Because of its low profile, ventilator 40 is inconspicuous and attractive when concealed under cap shingles 44.

By mounting a plurality of ventilators 40 across the roof ridge 12, full-length attic ventilation is provided for faster venting of the hot and humid air. Flowing through roof vents 26 and 126 and side wall perforations 84, such hot and humid air is vented to the exterior of the roof.

What is claimed is:

1. For use with a building roof ridge having a ridge pole supported on each side by rafters extending to said ridge pole spaced therealong and sloping downwardly therefrom, with sheathing and roof shingles supported by said rafters and having their inner longitudinal edges spaced from said ridge pole to provide a building roof vent extending longitudinally along at least one side of said ridge pole, a flexible, one-piece, roof ridge ventilator adapted for mounting transversely across said roof ridge with its outer longitudinal edges spaced transversely outwardly from said ridge pole for supporting thereon a longitudinally and transversely extending cap shingle with its longitudinally extending outer edges spaced above and transversely overlapping said roof shingles on both sides of said ridge pole for ventilation of said building through said roof vent said roof ridge ventilator having a plurality of longitudinally extending peaks and valleys with side walls extending therebetween, including a central valley adapted for mounting on said ridge pole, for centering said ridge ventilator sheet transversely across said roof ridge with side peaks and valleys extending from said ridge pole for a substantial distance to the outer longitudinal edges of said ventilator for overlapping said sheathing and shingles on both sides of said ridge pole said central valley and said side valleys having nail apertures therein for securing said ridge ventilator onto said ridge pole and said sheathing and shingles and the outermost of said side peaks having nail apertures therein adapted to receive nails for securing said cap shingle to said ridge ventilator, and said side walls having a plurality of venting perforations therein for venting of air therethrough from said roof vent to the exterior of said roof.

2. A roof ridge ventilator as claimed in claim 1, further including upwardly and outwardly turned flanges extending continuously along its outer longitudinal edges to prevent entry of moisture into said roof vent while allowing venting through said roof ridge ventilator, said flanges having water run-off perforations therein to allow the exit of water therethrough, thereby eliminating accumulation of water in said ventilator from run-off water of said cap shingles.

3. For use with a building roof ridge having a ridge pole supported on each side by rafters extending to said ridge pole spaced therealong and sloping downwardly therefrom, with sheathing and roof shingles supported by said rafters and having their inner longitudinal edges spaced from said ridge pole to provide a building roof vent extending longitudinally along at least one side of said ridge pole, a flexible, one-piece, roof ridge ventilator adapted for mounting transversely across said roof ridge with its outer longitudinal edges spaced transversely outwardly from said ridge pole for supporting thereon a longitudinally and transversely extending cap shingle with its longitudinally extending outer edges spaced above and transversely overlapping said roof shingles on both sides of said ridge pole for ventilation of said building through said roof vent said roof ridge ventilator having a plurality of longitudinally extending peaks and valleys with side walls extending therebetween, including a central valley adapted for mounting on said ridge pole, for centering said ridge ventilator sheet transversely across said roof ridge with a plurality of side peaks and side valleys extending from said ridge pole for a substantial distance to the outer longitudinal edges of said ventilator for overlapping said sheathing and shingles on both sides of said ridge pole said side peaks lying in a common plane and said side valleys lying in a plane parallel thereto with said central valley spaced below said valley plane before installation and after installation across said roof ridge said side peaks and said side valleys lying in parallel planes on each side of said ridge pole said central valley and said side valleys having nail apertures therein for securing said ridge ventilator onto said ridge pole and said sheathing and shingles on the outermost of said side peaks having nail apertures therein adapted to receive nails for securing said cap shingle to said ridge ventilator said side walls having a plurality of venting perforations therein for venting of air therethrough from said roof vent to the exterior of said roof, and said ventilator including upwardly and outwardly turned flanges extending continuously along its outer longitudinal edges to prevent entry of moisture into said roof vent while allowing venting through said roof ridge ventilator, said flanges having water run-off perforations therein to allow the exit of water therethrough, thereby eliminating accumulation of water in said ventilator from run-off water of said cap shingles.

* * * * *

UNITED STATES PATENT AND TRADEMARK OFFICE

CERTIFICATE OF CORRECTION

PATENT NO. : 4,280,399

DATED : July 28, 1981

INVENTOR(S) : Joseph M. Cunning

It is certified that error appears in the above-identified patent and that said Letters Patent are hereby corrected as shown below:

Column 4, line 3, "5/8 inch" should be --3/8 inch--.

Signed and Sealed this

*Seventeenth* Day of *November 1981*

[SEAL]

*Attest:*

GERALD J. MOSSINGHOFF

*Attesting Officer*

*Commissioner of Patents and Trademarks*